US005554982A

United States Patent [19]

Shirkey et al.

[11] Patent Number: 5,554,982

[45] Date of Patent: Sep. 10, 1996

[54] WIRELESS TRAIN PROXIMITY ALERT SYSTEM

[75] Inventors: Keith L. Shirkey, Tucson, Ariz.; Bruce A. Casella, Rancho Cucamonga, Calif.

[73] Assignee: Hughes Aircraft Co., Los Angeles, Calif.

[21] Appl. No.: 283,460

[22] Filed: Aug. 1, 1994

[51] Int. Cl.[6] ..... G08G 1/16

[52] U.S. Cl. ..... 340/903; 340/901; 340/902; 340/989; 340/994; 246/5; 246/7; 246/122 R; 246/293

[58] Field of Search ..... 340/901, 902, 340/903, 904, 933, 994, 989; 246/5, 7, 122 R, 124, 270 R, 293; 364/494

[56] References Cited

U.S. PATENT DOCUMENTS

| | | | |
|---|---|---|---|
| 3,758,775 | 9/1973 | Hopkins | 340/933 |
| 4,182,989 | 1/1980 | Endo et al. | 340/933 |
| 4,196,412 | 4/1980 | Sluis et al. | 340/32 |
| 4,735,383 | 4/1988 | Corrie | 246/122 R |
| 4,837,700 | 6/1989 | Ando et al. | 364/449 |
| 4,942,395 | 7/1990 | Ferrari | 340/907 |
| 5,092,544 | 3/1992 | Petit et al. | 246/122 R |
| 5,129,605 | 7/1992 | Burns et al. | 246/122 R |
| 5,155,689 | 10/1992 | Wortham | 364/449 |
| 5,307,060 | 4/1994 | Prevulsky et al. | 840/901 |
| 5,307,349 | 4/1994 | Shloss et al. | 370/85.2 |
| 5,394,029 | 2/1995 | Gay et al. | 364/449 |
| 5,440,489 | 8/1985 | Newman | 340/994 |

OTHER PUBLICATIONS

R. Dixon, *Spread Spectrum Systems*, John Wiley & Sons, NY 1984, pp. 1–14.

T. A. Stansell, "Civil GPS from a Future Prospective", *Proceedings of the IEEE*, vol. 71, No. 10, Oct. 1983, pp. 1187–1191.

*Primary Examiner*—Brent A. Swarthout
*Assistant Examiner*—Ashok Mannava
*Attorney, Agent, or Firm*—Jeanette M. Walder; Wanda K. Denson-Low

[57] ABSTRACT

A wireless train proximity alert system provides a constant warning signal to warn vehicles approaching a train crossing when a train is also approaching the crossing. The system includes a transceiver, positioned on the train itself or at the side of the track, for transmitting a train proximity signal, which preferably includes the train's speed and position. A crossing-based transceiver receives the train's proximity signal and transmits the boundary coordinates of a warning zone when the train's estimated time-to-arrival at the crossing is within a predetermined range. A vehicle-based receiver receives the warning zone signal and the crossing's position, compares them to the vehicle's position and speed, and produces an alarm to the vehicle's operator when a potential accident is indicated.

12 Claims, 6 Drawing Sheets

WIRELESS TRAIN PROXIMITY ALERT SYSTEM

BACKGROUND OF THE INVENTION

1. Field of the Invention

The present invention generally relates to wireless train crossing warning systems, and more specifically to a wireless train proximity alert system that provides a constant warning time signal.

2. Description of the Related Art

There are several hundred thousand railroad grade crossings exist at the intersection of railways and roads in the United States alone. It is important to provide reliable and accurate warning signals of approaching trains to prevent accidents. Many of these crossings are instrumented with the conventional "crossbuck" warning bell and light mounted pole which are very expensive to build and maintain. However, over 100,000 grade crossings have no warning system.

U.S. Pat. No. 4,942,395 discloses a "Railroad Grade Crossing Motorist Warning System" that includes a locomotive mounted transceiver for transmitting a constant and directional radio frequency beacon and a transceiver mounted at a railroad grade crossing for receiving the beacon signal and emitting an omnidirectional radio warning signal, and assumes that all vehicles will be equipped with a receiver for receiving the warning signal and activating visual and audio alarms for the driver. In this system, the train emits a signal of constant strength that attenuates as it propagates away from the train. As the train gets closer to the crossing grade the received signal strength increases until it exceeds a threshold at which time the crossing-based transceiver emits the warning signal. Similarly, as the vehicle approaches the crossing grade, the received strength of the warning signal increases until it exceeds another threshold and activates the alarm.

This approach can be inaccurate, since it doesn't account for the train's speed, the region's topography or the vehicle's speed. If the train or vehicle is traveling either very fast or very slow the alarm may be too early making it possible for the driver to forget, or too late for the driver to respond. Furthermore, tunnels or mountains can effect the signal's strength. With a beacon mounted on the locomotive and projecting a directional signal, the warning signal and alarm will be deactivated when the locomotive passes the crossing-based transceiver while the rest of the train is still passing through the crossing. Thus, approaching vehicles may not receive the warning signal and produce the alarm and may run into the side of the train. Approximately one-third of all crossing accidents involve this type of accident.

The crossing-based transceiver projects the warning signal in all directions, and can cause many false alarms in vehicles traveling away from the crossing or on non-intersecting roads. A high occurrence of false alarms is not only annoying, but dangerous because the vehicle's operator may lose confidence in the system and ignore a true alarm. If the crossing transceiver should fail, the warning signal will not be transmitted and the train will be unaware of the failure. Furthermore, when an accident does occur, it is important to be able to establish the sequence of events leading up to the accident, especially the confirmed reception of the warning signal by the vehicle. This system has no tracking capabilities.

SUMMARY OF THE INVENTION

The present invention seeks to provide a wireless train proximity alert system that accurately estimates a train's time to arrival, controls the size of the warning zone, generates a timely warning signal to the drivers of individual vehicles, deactivates the warning zone once the train has passed, provides a vehicle identification code and includes a backup system.

This is accomplished with a transmission device, positioned on the train itself or at the side of the track, for transmitting a train proximity signal, that preferably provides information on the train's speed and position. A crossing-based transceiver receives the train's proximity signal and transmits the boundary coordinates of a warning zone when the train's estimated time-to-arrival at the crossing is within a predetermined range. A vehicle-based receiver receives the warning zone signal and the crossing's position, determines the vehicle's position and speed and produces an alarm to the vehicle's operator when the vehicle is inside the warning zone and its distance to the crossing is within another predetermined range, which is a function of the vehicle's speed. The warning zone inhibits the activation of the alarm until the vehicle's inside the zone to reduce the number of false alarms.

For a better understanding of the invention, and to show how the same may be carried into effect, reference will now be made, by way of example, to the accompanying drawings.

DETAILED DESCRIPTION OF THE INVENTION

Figure 1:
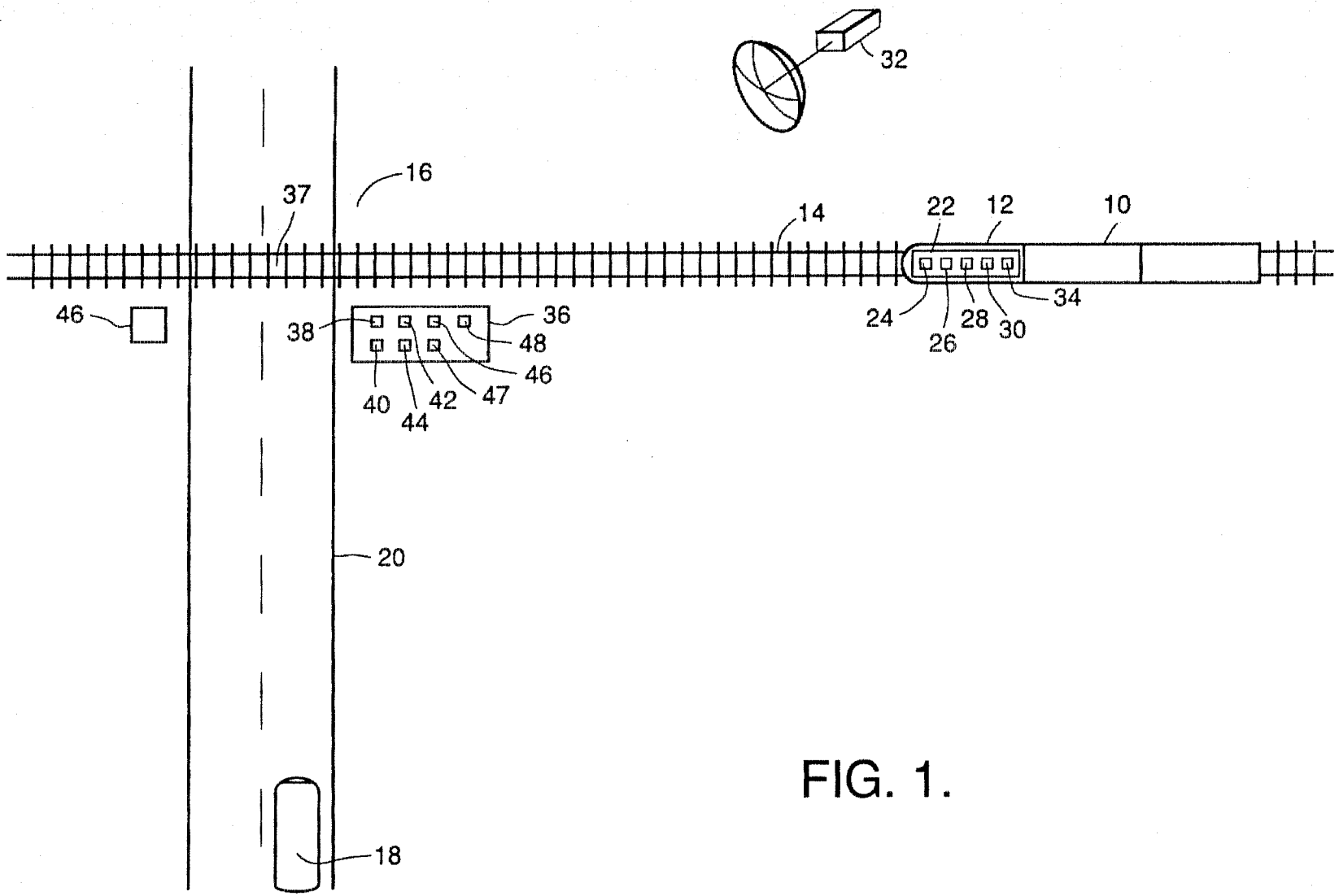
FIGS. 1–4 are simplified overhead views showing a train proximity alert system with a train mounted transceiver for broadcasting a proximity signal.

FIG. 1 shows an embodiment of the invention for a train proximity alert system. The system as described is a stand-alone system, but can be used in conjunction with the conventional "crossbuck" systems. A train 10 with a master locomotive 12 travels on a track 14 towards a grade crossing 16, while a vehicle 18 travels along a road 20 that crosses the track at the grade crossing. A Vehicle Proximity Alert System (VPAS) 22 that includes a narrow band radio frequency (RF) transceiver 24, a Global Positioning System (GPS) receiver 26 and a controller 28 is installed on top of the locomotive 12. The GPS receiver receives the locomotive's updated coordinates 30 from a GPS satellite network 32 and computes the train's speed 34. The receiver is periodically interrogated by the controller, e.g., every 5 seconds. The GPS network is discussed in Stansell "Civil GPS from a Future Prospective", *Proceedings of the IEEE*, Vol. 71, No. 10, October 1983, pp. 1187–1191. The transceiver 24 periodically transmits the train's coordinates 30 and speed 34 to the next grade crossing 16.

A crossing-based Warning and Verification System (WAVS) 36 is installed at the grade crossing, the coordinates 37 of which are known. The WAVS includes a narrow band RF transceiver 38, a spread-spectrum transceiver 40, a controller 42, a Vehicle-to-Roadside Communication (VRC)

transponder 44 and Train Detection Device (TDD) sensors 46. A suitable VRC transponder system is disclosed in U.S. Pat. No. 5,307,349 entitled "TMA Network and Protocol for Reader-Transponder Communications and Method".

The transceiver 38 receives the train's coordinate 30 and speed 34 information from the signal transmitted by the train-mounted transceiver 24, and in response transmits a "handshake" signal 47 to tell the train's VPAS 22 that the WAVS 36 is working properly. The controller 42 monitors the train's estimated time-to-arrival 48 at the grade crossing, which is based on the train's speed 34 and the euclidean distance between the crossing's coordinates 37 and the train's coordinates 30. The actual distance along the track may be longer, but the estimate should be adequate for a range of 1–2 miles since trains are generally limited to long slow turns.

Figure 2:
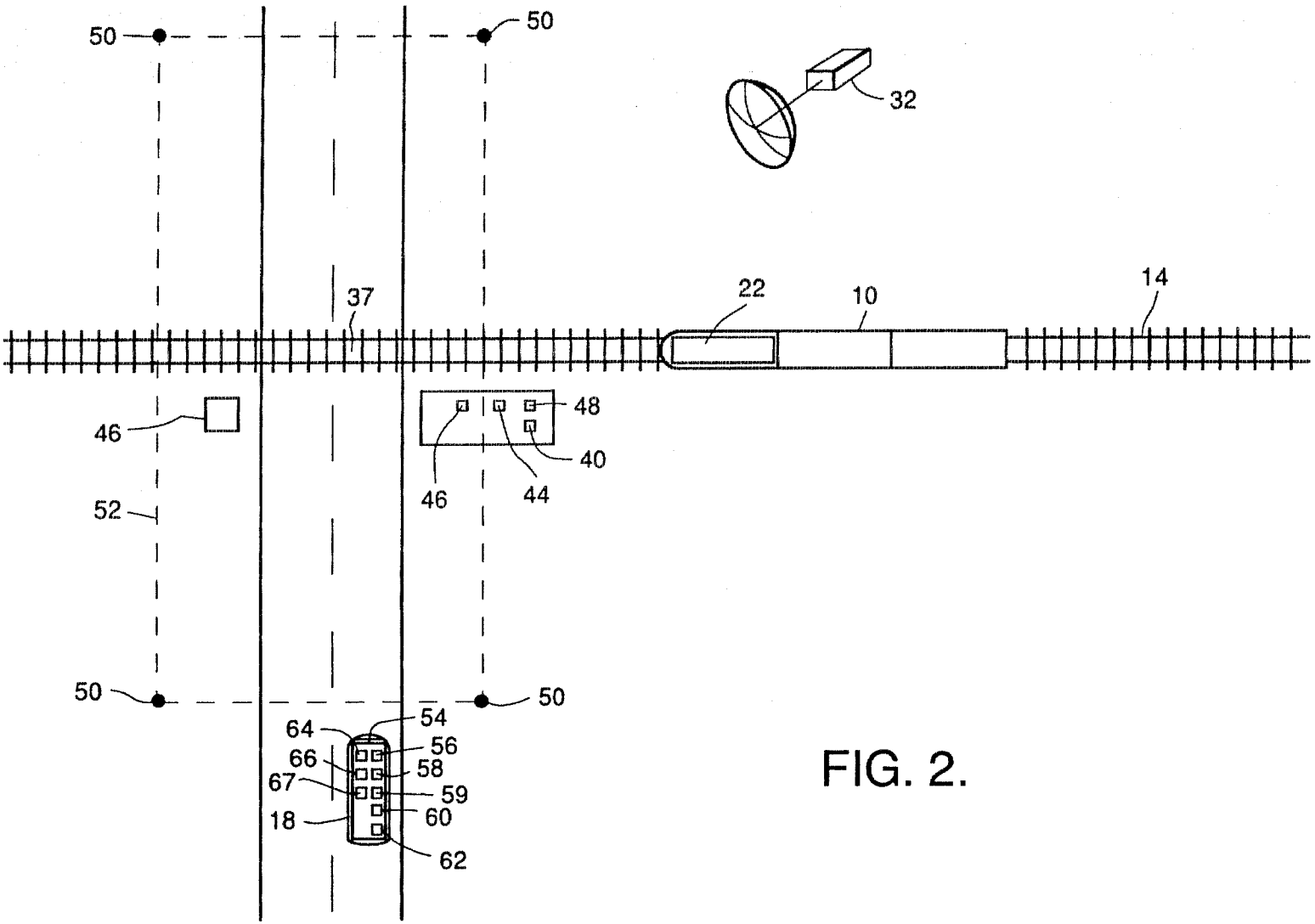

As shown in FIG. 2, when the train's time-to-arrival 48 is computed to be within a given range from the crossing, e.g., twenty to thirty seconds, the crossing transceiver 40 transmits the crossing's coordinates 37 and a set of boundary coordinates 50 that define a warning zone 52 which inhibits a vehicle from activating an alarm until it is inside the warning zone, and activates the VRC transponder 44 and TDD sensors 46. The boundary coordinates 50 are preprogrammed for each WAVS based upon the particular grade crossing's surrounding topography and the worst case scenario for an approaching vehicle. To reduce the number of false alarms, the size of the warning zone is selected if possible to only alert vehicles on roads that pass through the crossing. The warning zone is large enough for the worst case scenario of a large truck traveling at a speed of approximately 80 mph, approximately one-half to three-quarters of a mile, for the receiver to process the information and produce the alarm, and for the driver to respond to the alarm and initiate braking to stop the vehicle. The TDD sensors determine when the train has passed through the crossing, and at that time deactivate the warning zone signal. The TDD sensors are preferably short range doppler radars, but could also be optical detectors.

A vehicle-based VPAS 54 is installed in the vehicle 18 and includes an RF receiver 56, a GPS receiver 58, a spread-spectrum receiver 59, a controller 60, a VRC transponder 62, and alarms such as a blinking light 64 and a beeper 66. Eventually, the VPAS system will share many of these hardware components with computer mapping and crash avoidance systems that will be available as standard equipment on the vehicles. The controller 60 periodically interrogates the GPS receiver 58 to update the vehicle's coordinates and speed. When the spread-spectrum receiver 59 receives the warning signal that includes the grade crossing's coordinates and the boundary coordinates 50 of the warning zone 52, the controller determines whether the vehicle is inside the warning zone. If the vehicle is outside the zone, the controller is inhibited from producing an alarm signal. Once the vehicle is within the warning zone, the controller monitors the vehicle's estimated distance 67 to the grade crossing. For simplicity the distance is also based on the vehicle's euclidean distance to the crossing, and may therefore slightly underestimate the actual distance. In a more advanced system, mapping software could be used to compute a more accurate estimate.

Figure 3:
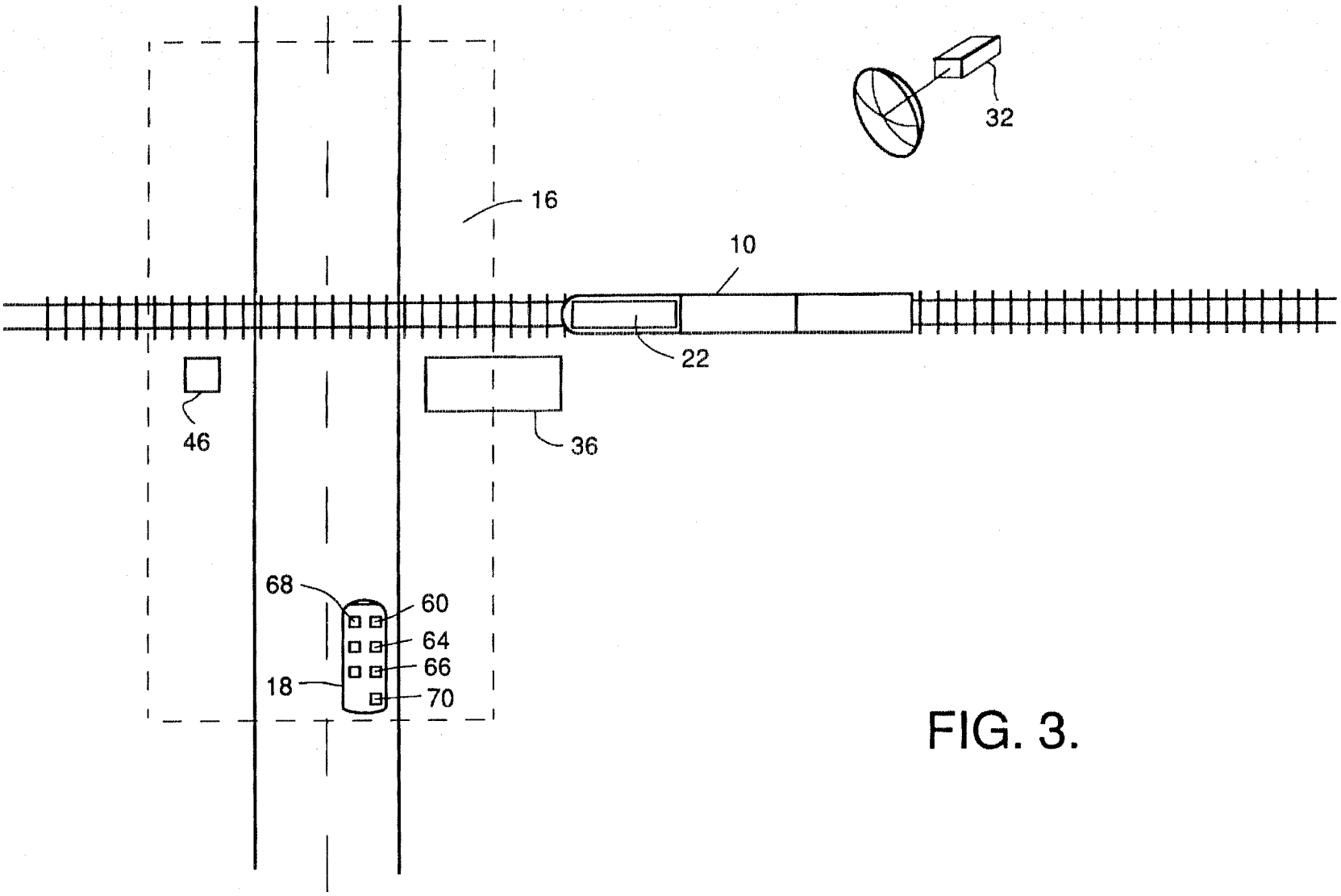
Figure 4:
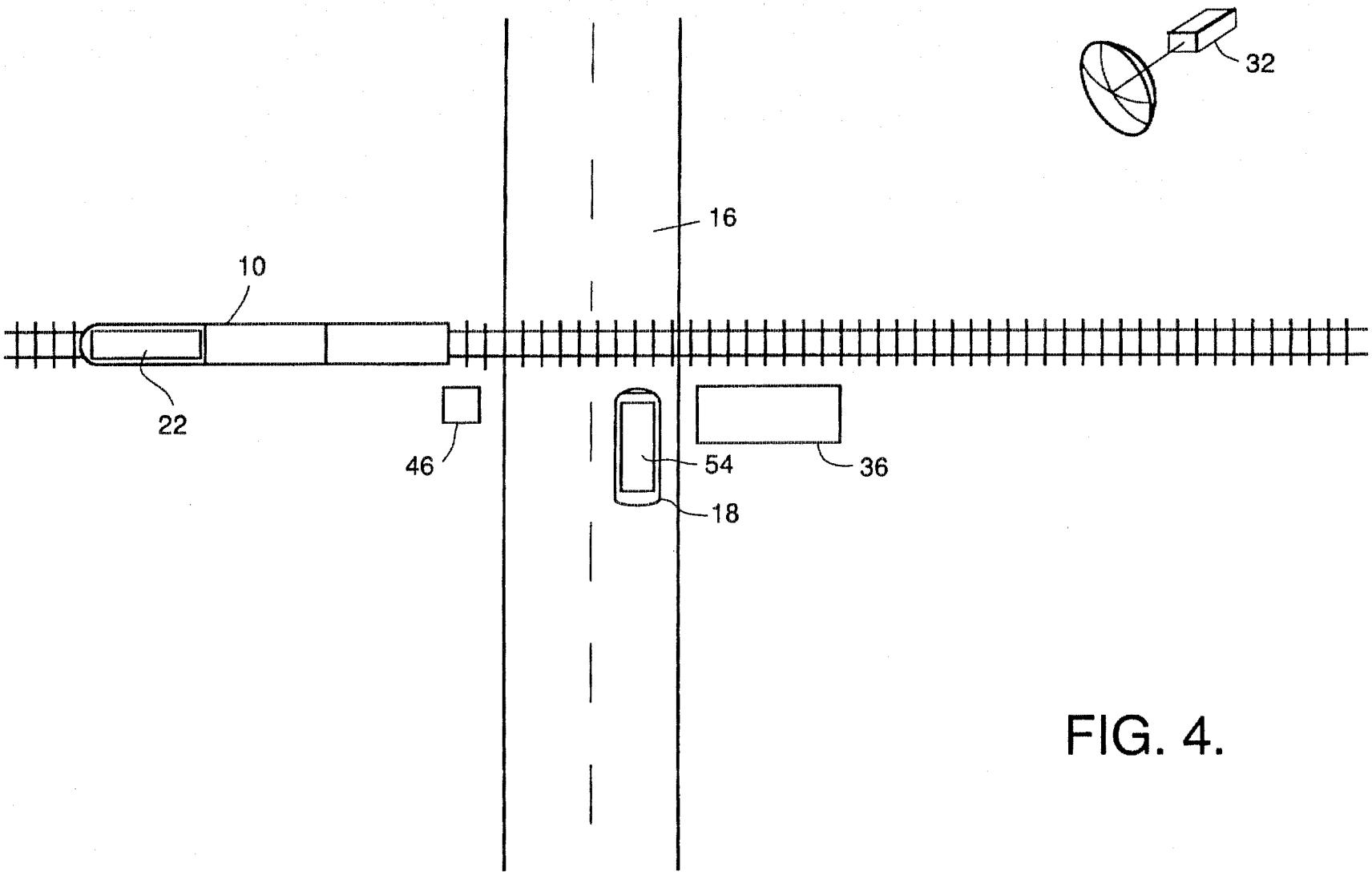

As shown in FIG. 3, when the vehicle's estimated distance is within a predetermined range, the controller 60 produces an alarm signal 68 that activates the blinking light 64 and beeper 66 to alert the vehicle's operator of the upcoming grade crossing 16 and approaching train 10. The light and beeper preferably respond for 2–3 seconds, and are then deactivated. The range includes the vehicle's braking distance, a response distance for the driver and a distance for the controller to process the information and activate the alarm, which are a function of the vehicle's speed. The higher its speed the longer the respective distances. The braking distance is also a function of the vehicle's type; a commercial truck's braking distance at a given speed is longer than a car's. The response distance provides a 6–10 second lead time to allow the driver to assimilate the alarm and initiate braking. Alarms that occur more than ten seconds in advance tend to be ignored, while alarms less than six seconds in advance can fail to provide adequate response time for the vehicle's operator. For example, at 40 mph the total distance (range) for a car is approximately 1160 feet and for a heavy truck is about 1320 feet. At 80 mph the distances increase to approximately 3150 and 3770 feet respectively. As shown in FIG. 4, when the train 10 has passed the crossing 16 the TDD sensor 46 deactivates the warning zone signal.

Referring to FIG. 3, vehicles, and particularly high risk vehicles such as trucks hauling hazardous materials, may be provided with a vehicle identification code 70 that is transmitted via VRC transponder 62 when the controller initiates the alarm 68. The WAVS VRC transponder 44 receives the identification code and logs it along with a time stamp to confirm that the warning zone was sent to and received by the vehicle. In the case of an accident, the identification records provide evidence of whether the alert system failed or the vehicle's operator didn't respond to the alarm.

If the WAVS 36 should fail due to systems problems, vandalism or an accident at the crossing, the train mounted transceiver 24 broadcasts a general warning signal to nearby vehicles. As the train passes each crossing grade, the WAVS unit transmits the coordinates of the next several crossing grades so that the train's VPAS 22 will know when to expect the "handshake" signal 47 from the next WAVS unit. If the VPAS 22 doesn't receive the "handshake" in time, it knows the WAVS unit is disabled and broadcasts a general warning signal which is received by the RF receivers 46 of all vehicles within range. In general, transmitting a warning signal from the WAVS is preferable to transmitting it from the train because it provides a precise warning zone, deactivates the signal and provides more reliable communications over the spread-spectrum network.

The spread-spectrum network comprising the transceiver 38, receiver 59 and VRC transponders 44 and 62 is a low-power system which can currently be operated in the United States without a government license. Such a network has an operating range of ¼ to ¾ mile. An overview of spread spectrum communications is presented in a textbook by R. Dixon, *SPREAD SPECTRUM SYSTEMS,* John Wiley & Sons, New York 1984, pp. 1–14. Although the network can be implemented using conventional narrow-band RF communication within the scope of the invention, spread-spectrum communication is preferable in that it offers the advantages of network security and resistance to interference and jamming. It can also operate reliably in an electromagnetic environment.

In the preferred embodiment the WAVS unit transmitted the crossing's coordinates and warning zone coordinates, and once inside the warning zone the vehicle's VPAS monitored its distance to the crossing and sounded the alarm. Alternatively, the WAVS unit could transmit only the crossings coordinates as an indicator of an approaching train, whereby the vehicle would monitor its estimated distance to the crossing as soon as it received the coordinates and sound the alarm when appropriate. This approach would be simpler but might increase the number of false alarms. In another embodiment, the WAVS could transmit only the warning zone coordinates, and once inside the zone the vehicle would immediately sound the alarm. This approach would simplify the vehicle's receiver, but might effect the timeliness of the alarm in some cases.

Figure 5:
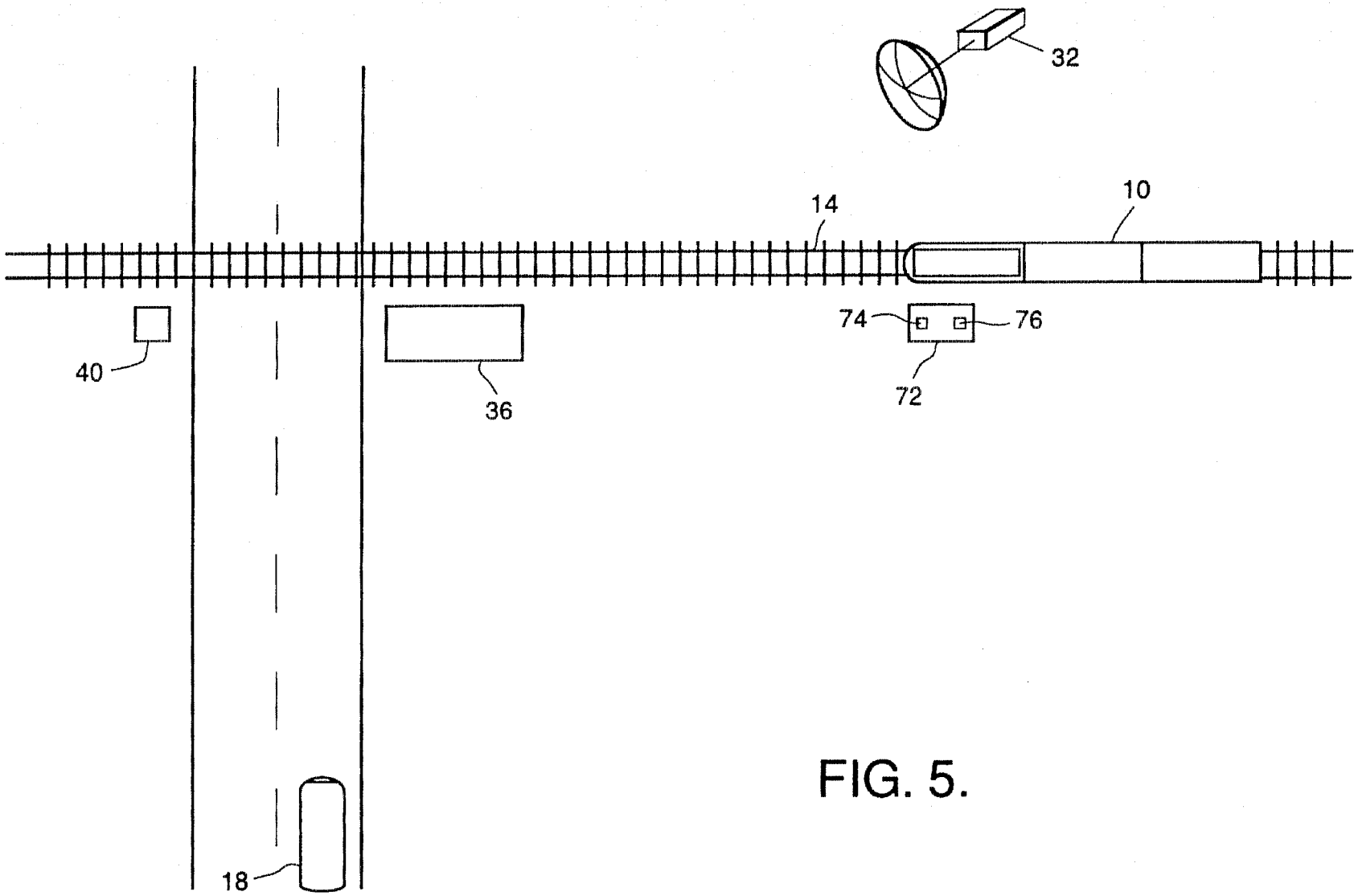
FIG. 5 is a simplified overhead view showing a train proximity alert system with a detector/transmitter positioned at the side of the track for broadcasting the proximity signal.

In yet another embodiment shown in FIG. 5, the train mounted VPAS 22 is replaced by a train detection device (TDD) 72 positioned at the side of the tracks at a known distance from the crossing, e.g., ½ to 1 mile. The TDD 72 includes a pole mounted short range doppler radar unit 74 and a narrow-band RF transmitter 76. The radar unit detects the train and provides its speed to the transmitter, which transmits it to the WAVS 36 to initiate the transmission of a WAVS warning signal. In this implementation, the coordinates of the TDD are known and preprogrammed into the WAVs unit.

Figure 6:
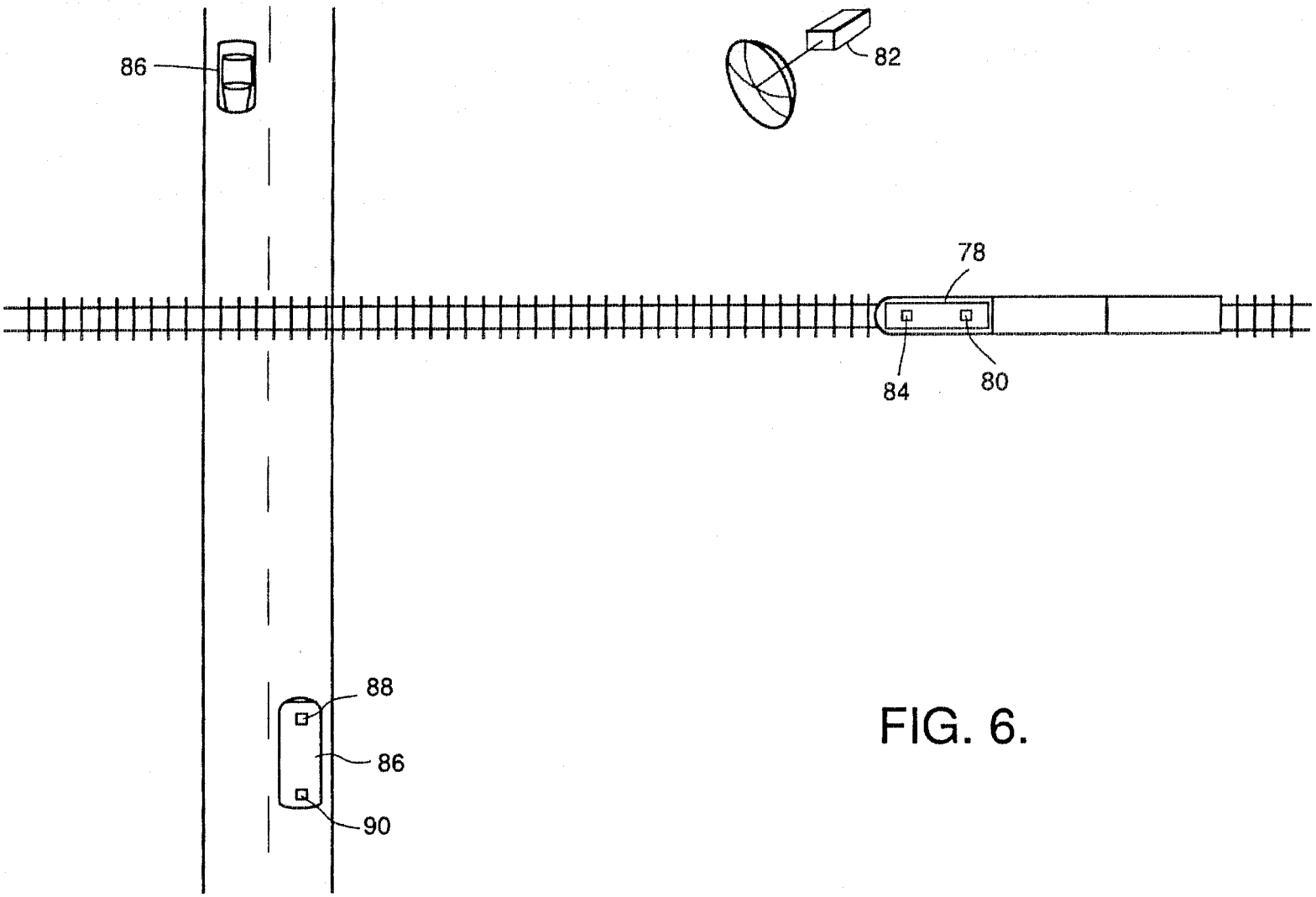
FIG. 6 is a simplified overhead view showing a train proximity alert system with a train mounted transceiver for broadcasting a proximity signal and a vehicle mounted receiver.

In another alternative embodiment, the train's VPAS 22 (FIG. 1) computes the estimated time-to-arrival and transmits it to the WAVS 36, which monitors the time and transmits the boundary coordinates 50 of the warning zone 52 when appropriate. In another embodiment (FIG. 6) the WAVS unit is eliminated, the train's VPAS 78 is preprogrammed with the crossings' coordinates 80 or receives them via satellite 82 from a central control station and a transceiver 84 transmits them directly to all vehicles 86 within range. The vehicles's receivers 88 receive the coordinates 80 and compute their respective distances and sound their warning signals 90.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A wireless train proximity alert system for alerting a vehicle's operator-to a train's approach into a grade crossing, comprising:

a transmitter for transmitting a train proximity signal;

a crossing-based transceiver for receiving the train's proximity signal and transmitting a set of boundary coordinates that define a warning zone around the grade crossing, said warning zone having a size and shape based upon the grade crossing's surrounding topography; and a vehicle-based receiver for receiving the boundary coordinates and, after the vehicle enters the warning zone, activating an alarm to warn the vehicle's operator.

2. The wireless train proximity alert system of claim 1, wherein said transmitter is mounted on the train and comprises a first geolocator for providing the train's position, said transmission device periodically interrogating said first geolocator to update the train's position and estimate its speed and transmit the train's speed and position as said proximity signal, and said crossing-based transceiver computes an estimate of the train's time-to-arrival at the crossing and, when the time is within a predetermined range, transmits the boundary coordinates.

3. The wireless train proximity alert system of claim 1, wherein said crossing-based transceiver transmits the crossing's position, and said vehicle-based receiver comprises a transceiver and a geolocator for providing the vehicle's position, said vehicle-based transceiver periodically interrogating said geolocator to update the vehicle's position and estimate its speed, computing an estimate of the vehicle's time-to-arrival at the crossing when the vehicle is with said warning zone and, when the vehicle's time-to-arrival is within a response time range, which is independent of both the vehicle's speed and distance to the crossing, activating said alarm.

4. The wireless train proximity alert system of claim 3, wherein said response time range has a lower time limit that is calculated to provide vehicle operators with adequate time to respond to the alarm and an upper time limit that is calculated to induce vehicle operators to react to the alarm.

5. The wireless train proximity alert system of claim 4, wherein said vehicle-based receiver activates the alarm to warn the vehicle operator and then deactivates the alarm before the vehicle arrives at the grade crossing.

6. The wireless train proximity alert system of claim 1, wherein said transmitter is disposed on a side of the track at a known position, said transmitter comprising:

a detector section for detecting said train and computing its speed; and a transmitter section for transmitting the train's speed to the crossing-based transceiver, said transceiver computing an estimate of the train's time-to-arrival at the crossing and, when the time is within a predetermined range, transmitting the boundary coordinates.

7. The wireless train proximity alert system of claim 1, wherein said crossing-based transceiver comprises a detector that detects when the end of the train has passed through the crossing and deactivates the warning zone immediately thereafter.

8. The wireless train proximity alert system of claim 1, wherein the grade crossing's surrounding topography includes a road that passes through the grade crossing, said set of boundary coordinates defining said warning zone to only alert vehicles traveling on said road.

9. The wireless train proximity alert system of claim 1, comprising a plurality of said crossing-based transceiver located at respective grade crossings, said crossing-based transceivers transmitting respective sets of boundary coordinates that define warning zones around the respective grade crossings, said warning zones having sizes and shapes based upon their respective unique surrounding topographies.

10. A wireless train proximity alert system for producing a warning signal of a train's approach into a grade crossing, comprising:

a transmitter for transmitting a train proximity signal; and a crossing-based transceiver for receiving the train's proximity signal and transmitting a set of boundary coordinates that define a warning zone around the grade crossing when the train's estimated time-to-arrival at the crossing is within a predetermined range, said warning zone having a size and shape based upon the grade crossing's surrounding topography.

11. The alert system of claim 10, wherein said transmitter is mounted on said train and transmits the train's position and speed, and said crossing-based transceiver computes the train's estimated time-to-arrival at the crossing based upon the transmitted position and speed.

12. The alert system of claim 11, wherein said set of boundary coordinates includes the crossing's position.

* * * * *